US007475635B2

(12) United States Patent
Bambach

(10) Patent No.: US 7,475,635 B2
(45) Date of Patent: Jan. 13, 2009

(54) PROJECTILE SEALING ARRANGEMENT

(75) Inventor: Ramon John Bambach, Victoria Point (AU)

(73) Assignee: Metal Storm Limited, Brisbane (AU)

( * ) Notice: Subject to any disclaimer, the term of this patent is extended or adjusted under 35 U.S.C. 154(b) by 0 days.

(21) Appl. No.: 10/512,003

(22) PCT Filed: Mar. 17, 2003

(86) PCT No.: PCT/AU03/00318

§ 371 (c)(1),
(2), (4) Date: Jul. 5, 2005

(87) PCT Pub. No.: WO03/089871

PCT Pub. Date: Oct. 30, 2003

(65) Prior Publication Data

US 2005/0268807 A1 Dec. 8, 2005

(30) Foreign Application Priority Data

Apr. 19, 2002 (AU) ..... PS1828

(51) Int. Cl.
*F42B 5/03* (2006.01)

(52) U.S. Cl. ..... 102/438; 102/338; 102/348; 102/352; 89/135; 86/20.1

(58) Field of Classification Search ..... 102/438, 102/338, 352, 360, 335, 217, 494–497, 345; 86/20.1; 42/84; 89/20.1
See application file for complete search history.

(56) References Cited

U.S. PATENT DOCUMENTS 694,896 A * 3/1902 Scott ..... 102/438
2,099,993 A 11/1937 Tauschek
2,313,030 A * 3/1943 Tauschek ..... 89/135
2,381,332 A 8/1945 Boldt (Continued)

FOREIGN PATENT DOCUMENTS

DE 17171 3/1882

(Continued)

OTHER PUBLICATIONS

Search Report, "International Search Report", PCT/AU03/00318, (May 16, 2003),pp. 6.

*Primary Examiner*—Bret Hayes
*Assistant Examiner*—Benjamin P Lee
(74) *Attorney, Agent, or Firm*—Blakely Sokoloff Taylor & Zafman LLP

(57) ABSTRACT

A projectile sealing arrangement for a barrel assembly of a weapon wherein a plurality of projectile assemblies (10) are axially disposed in abutting relationship within a barrel (20), each projectile assembly (10) including a body (11) associated with a discrete propellant charge (15); said sealing arrangement comprising rearward opening (13) communicating with cavity (14) provided in said projectile assembly (10) for retaining the discrete propellant charge (15) and a forward portion (16) of an abutting projectile arranged for operative sealing engagement with a complementary portion (17) of the rearward opening (13). The sealing arrangement suitably includes surface portions of complementary shapes such that, during application of a compressive load (L) to abutting projectile assemblies (10), discrete propellant charge (15) is scaled within the cavity (14). There is also disclosed and claimed a chain of individual projectiles connected head to tail by complementary spigot and socket members.

15 Claims, 5 Drawing Sheets

U.S. PATENT DOCUMENTS

| | | | | | |
|---|---|---|---|---|---|
| 2,938,430 | A | | 5/1960 | Pion | |
| 3,139,795 | A | | 7/1964 | Altschuler | |
| 3,412,681 | A | * | 11/1968 | Schirneker | 102/438 |
| 3,451,306 | A | | 6/1969 | Lagerstrom et al. | |
| 3,815,271 | A | * | 6/1974 | Lynn | 42/84 |
| 3,854,231 | A | | 12/1974 | Broyles | |
| 3,899,975 | A | * | 8/1975 | Lawrence | 102/505 |
| 4,026,188 | A | | 5/1977 | Woodruff | |
| 4,123,975 | A | * | 11/1978 | Mohaupt | 102/518 |
| 4,285,153 | A | * | 8/1981 | Crouch | 42/84 |
| 4,433,606 | A | * | 2/1984 | Hagelberg et al. | 89/1.812 |
| 4,549,489 | A | | 10/1985 | Billard et al. | |
| 4,586,439 | A | * | 5/1986 | Wrana | 102/438 |
| 4,621,579 | A | | 11/1986 | Badura et al. | |
| 4,708,064 | A | * | 11/1987 | Bisping et al. | 102/517 |
| 4,733,597 | A | | 3/1988 | Upham | |
| 4,878,432 | A | * | 11/1989 | Mikhail | 102/309 |
| 5,063,823 | A | | 11/1991 | Marshall et al. | |
| 5,074,186 | A | | 12/1991 | Marshall | |
| 5,092,221 | A | | 3/1992 | Travor | |
| 5,155,288 | A | | 10/1992 | Marshall | |
| 5,834,684 | A | * | 11/1998 | Taylor | 102/517 |
| 6,123,007 | A | * | 9/2000 | O'Dwyer | 89/135 |
| 6,138,395 | A | * | 10/2000 | O'Dwyer | 42/84 |
| 6,343,553 | B1 | * | 2/2002 | O'Dwyer | 102/438 |
| 6,431,076 | B1 | * | 8/2002 | O'Dwyer | 102/525 |
| 6,510,643 | B2 | * | 1/2003 | O'Dwyer | 42/84 |
| 6,543,174 | B2 | * | 4/2003 | O'Dwyer | 42/76.01 |
| 6,662,726 | B1 | * | 12/2003 | Steiner | 102/521 |
| 6,862,996 | B2 | * | 3/2005 | Key | 102/517 |
| 7,194,943 | B2 | * | 3/2007 | O'Dwyer | 89/28.05 |
| 2004/0231219 | A1 | * | 11/2004 | O'Dwyer | 42/84 |
| 2007/0028794 | A1 | * | 2/2007 | O'Dwyer | 102/520 |
| 2007/0056460 | A1 | * | 3/2007 | O'Dwyer et al. | 102/374 |

FOREIGN PATENT DOCUMENTS

| | | |
|---|---|---|
| GB | 124801 | 4/1910 |
| GB | 1534134 | 11/1978 |
| GB | 1594686 | 8/1981 |
| WO | WO-9420809 | 9/1994 |
| WO | WO-9855824 | 12/1998 |
| WO | WO-0062004 | 10/2000 |
| WO | WO-0062005 | 10/2000 |

* cited by examiner

PROJECTILE SEALING ARRANGEMENT

BACKGROUND OF THE INVENTION

1. Field of the Invention

This invention relates to projectile sealing arrangements for barrel assemblies wherein a plurality of projectile assemblies are disposed axially in abutting relationship within a barrel and associated with discrete propellant charges for selectively propelling respective projectiles sequentially from the barrel.

The invention relates particularly, although not exclusively, to barrel assemblies for weapons that employ electrical or electronic activation of ignition means for igniting the discrete propellant charges.

2. Discussion of the Background Art

The projectile sealing arrangements for barrel assemblies described in earlier International Patent Applications assigned to the present applicant, including PCT/AU94/00124, utilise operative sealing engagement between each projectile assembly and the bore of a barrel containing the projectile assemblies.

An important function of operative sealing engagement between projectile assemblies and the barrel bore is to prevent or at least minimise burn leakage of combustion products resulting from firing a leading projectile, which leakage might otherwise cause sympathetic ignition of propellant charges associated with trailing projectile assemblies within the barrel. These projectile assemblies include a variety of barrel seal configurations incorporated in sabots and wedging sleeves, rings or expandable portions—all arranged to seal against the bore of the barrel.

However the relative complexity and cost of manufacturing barrel assemblies utilising operative sealing engagement with the barrel detracts from some applications of the applicant's barrel assemblies, especially where high volume, low cost manufacture is anticipated.

SUMMARY OF THE INVENTION

Object of the Invention

The invention aims, in certain embodiments, to provide a projectile sealing arrangement for a barrel assembly wherein projectiles are disposed axially in a barrel so as to inhibit the action of firing a leading projectile from igniting the propellant of the rearward or trailing projectiles without a requirement for operative sealing engagement of projectiles with the barrel bore.

The invention also aims, in certain embodiments, to provide a projectile sealing arrangement for such barrel assemblies that is less complex, allows use of conventional rifling, facilitates reduced manufacturing cost or at least provides a useful choice.

Disclosure of the Invention

With the foregoing in view, this invention in one aspect resides broadly in a projectile sealing arrangement for a barrel assembly of a weapon wherein a plurality of projectile assemblies are axially disposed in abutting relationship within a barrel, each projectile assembly associated with a discrete propellant charge; said sealing arrangement comprising:

a rearward opening communicating with a cavity provided in each projectile assembly for containing the discrete propellant charge; and a forward portion of an abutting projectile assembly arranged for operative sealing engagement with the rearward opening;

the arrangement being such that, during application of a compressive load to abutting projectile assemblies, the discrete propellant charge is sealed within the cavity.

In another aspect, the present invention resides in a barrel assembly for a weapon; said barrel assembly including:

a plurality of projectile assemblies axially disposed in abutting relationship within a barrel, each projectile assembly associated with a discrete propellant charge;

ignition means for each propellant charge, whereby the discrete propellant charges may be selectively ignited to propel respective projectiles sequentially from the barrel; and a sealing arrangement between abutting projectile assemblies, said sealing arrangement comprising:

a rearward opening communicating with a cavity provided in each projectile assembly for receiving the discrete propellant charge; and a forward portion of an abutting projectile assembly arranged for operative sealing engagement with the rearward opening;

the sealing arrangement being such that, during the application of a compressive load to the abutting projectile assemblies, the discrete propellant charges for trailing projectiles are sealed within their respective cavities.

In a further aspect, the invention resides in a projectile assembly having a body with a head and a tail portion and characterised in that:

the head includes a forward portion arranged for operative sealing engagement with the rearward opening of a leading projectile;

the tail portion includes a rearward opening communicating with a cavity provided in the projectile assembly for receiving the discrete propellant charge, which opening includes a rear portion arranged for operative sealing engagement with the forward portion of a trailing projectile; and a sealing arrangement being such that, during the application of a compressive load to abutting projectile assemblies, the discrete propellant charge is sealed within the cavity.

Preferably the forward or head portion has a forward sealing surface of a predetermined shape, and the rearward opening has a rearward sealing surface of a substantially complementary shape to the predetermined shape of the forward sealing surface, whereby the sealing surfaces cooperate.

Alternatively, either or both of the forward portion and the rearward opening include a sealing means, such as a gasket, to aid or enhance sealing. The sealing means may be pre-formed as a resilient body, such as a gasket, or formed in-situ through the use of a suitable flowable sealing material. Most preferably, the sealing material has adhesive properties.

The sealing surfaces of the projectile body may be of any suitable shape, including hemispherical, conical or wedge cross-sectional shaped surface portions, whether dictated by aerodynamic considerations or otherwise. Suitably, the forward sealing surface has a convex shape and the cooperating rearward sealing surface has a complementary concave shape.

The projectile body may include a transverse surface on one of the head and tail portions of the projectile assemblies, which transverse surface is arranged to prevent over-travel of a projectile relative to its trailing projectile upon application of compressive loads thereto. The transverse surfaces may be planar or curved, as required.

The propellant charges may be provided in a solidified form or a flowable form, such as powder or granules.

The rearward opening may include a closure for retaining the propellant material within the cavity. The closure may comprise a mechanically burstable disc or a disc composed of combustible material.

The closure may include retaining means that releasably engage with complementary retaining means on the head. The retaining means suitable socket and spigot members that desirably include cooperating screw threads to convenient facilitate release. Alternatively the retaining means may be frangible. In either case a chain of projectile assemblies may be formed by selective engagement of such retaining means.

In a still further aspect, the invention resides in a chain of projectiles including at least two projectiles releasably coupled together, wherein each projectile assembly comprises a head portion and a tail portion and wherein a releasable coupling comprises a complementary spigot member and socket member, which coupling is disposed between the tail portion of a leading projectile and a head portion of a trailing projectile.

If required the spigot member and socket member of the coupling are provided with releasable engagement means, such as cooperating screw threads or frangible joint means.

BRIEF DETAILS OF THE DRAWINGS

In order that this invention may be more readily understood and put into practical effect, reference will now be made to the accompanying drawings that illustrate typical embodiments of the invention, wherein.

DESCRIPTION OF EMBODIMENTS OF THE INVENTION

Figure 1:
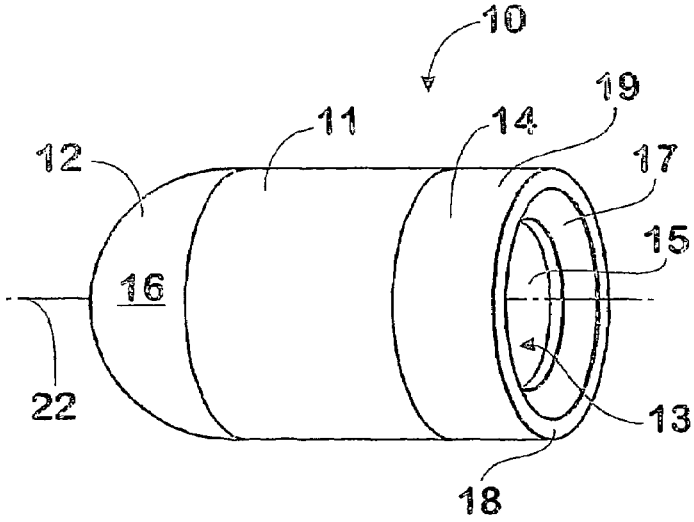
FIG. 1 is an isometric view of a projectile assembly of a first embodiment of the invention.
Figure 2:
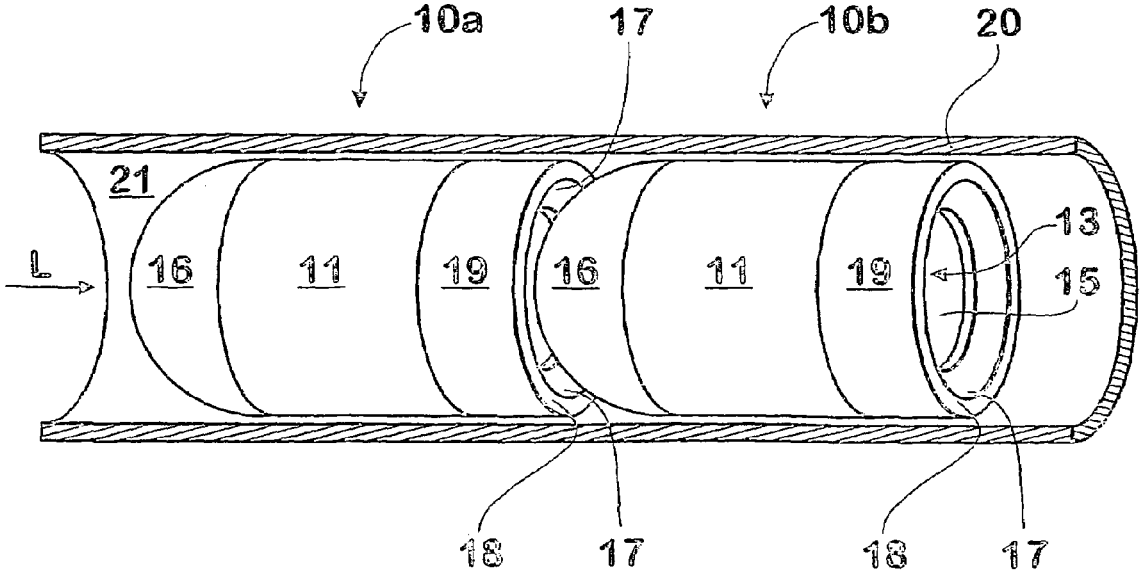
FIG. 2 is a partially fragmented isometric view of two projectile assemblies of the first embodiment in almost abutting relation within a barrel.

The projectile assemblies 10 of the first embodiment illustrated in FIGS. 1 and 2 each include a body 11 having a head or forward portion 12 and a mouth or rearward opening 13 at a tail portion 19, which opening communicates with a cavity 14 provided in the projectile body. The cavity 14 contains a discrete propellant charge 15 together with ignition means (not shown) for igniting the propellant charge. It will be appreciated that upon ignition of the propellant, suitably by electronic control means, combustion products including propellant gas will exit the projectile cavity 14 via the mouth 13 at the tail 19 of the projectile with considerable force.

In the first embodiment, a forward sealing surface 16 of the projectile head 12 is convex, having a simple hemispherical shape, whilst the mouth 13 has a peripheral sealing surface 17 that is provided or formed, at least in part, with a complementary concave shape to the hemispherical sealing surface 16 of head 12. The precise configuration of the shapes are relatively unimportant, other than the requirement that they be complementary in order to satisfy the desired purpose of providing a substantially gas tight seal upon application of a compressive load to abutting projectile assemblies. Such a seal is intended to avoid inadvertent ignition of propellant associated with trailing projectiles, as discussed in relation to FIG. 2. It is also desirable that the shapes utilised for the projectile provide sufficient strength to withstand the in-barrel forces that arise during firing of a weapon utilising the projectile assemblies.

Whilst a simple hemispherical shape is employed in this embodiment, many variations to this are possible. For example, one simple variation is the projectile head and the receiving tail of the projectile have cooperating conical or wedge cross-sectional shapes for improved sealing engagement. In some embodiments, the surface shape of the head or forward portion 12 of the projectile body 11 will be determined in accordance with aerodynamic considerations.

FIG. 2 illustrates two(2) of a plurality of projectile assemblies 10 axially disposed in nearly abutting relation within a barrel 20. The projectile assemblies are slightly separated and only a fragment of the barrel 20 is depicted for reasons of clarity. In normal operation, the forward surface 16 of the head 12 of the leading or left-hand projectile 10*a* would be in contact with the rearward peripheral surface 17 of the mouth 13 of the trailing or right-hand projectile 10*b*, due to the compressive action of loading projectiles into the barrel 20. The peripheral surface 17 extends inwardly of each projectile 10, both from a rear end annular face 18 at the tail of the projectile and from an outer surface of the projectile body 11 toward the longitudinal axis 22 of the projectile.

Upon the application of compressive load L to the abutting projectiles 10, the rearward peripheral surface 17 of the leading projectile 10*a* is operatively sealed against the forward surface 16 of the trailing projectile 10*b*, thereby sealing the propellant charge 15 within the cavity 14 in the projectile body 11. Typically further compressive loading results from ignition of a forwardmost projectile (not shown in FIG. 2) during the propulsion of the forwardmost projectile from the barrel 20.

It should be noted that the interaction between the projectile assemblies 10 and the wall or bore 21 of the barrel 20 of the present embodiment, at least insofar as any requirement for sealing is concerned, is the same as that for conventional projectiles and barrel walls in known weapons. Thus only a level of sealing between the outer cylindrical surface of the projectile body 11 and the barrel bore 21 which inhibits propellant gases from escaping past the head 12 of the projectile body 11 during firing, such as provided by conventional rifling, is necessary for reliable operation.

Figure 3:
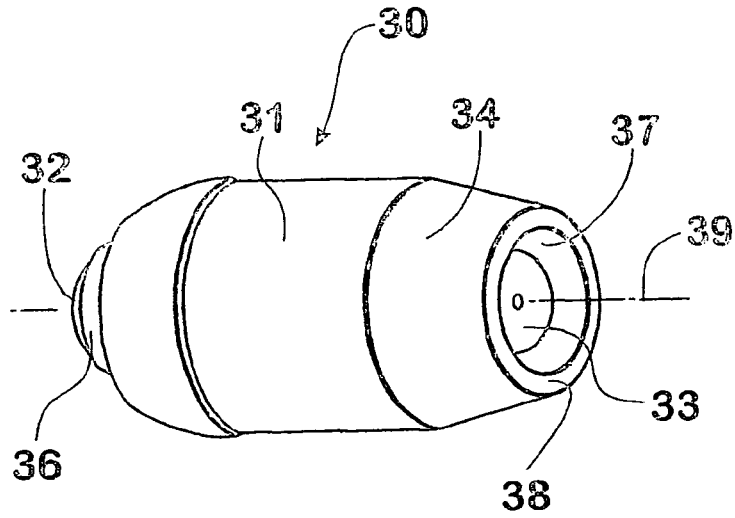
FIG. 3 is an isometric view of a projectile assembly of a second embodiment of the invention.

A projectile 30 in accordance with the second embodiment of the invention is illustrated in FIG. 3. The projectile 30 includes a body 31 having a reduced diameter head or forward portion 32 and a mouth or rearward opening 33 at a tail portion which mouth communicates with a cavity (not shown) provided in the projectile body. The projectile body 31 includes a frustro-concial tail portion 34 which terminates at an annular rear face 38 having a reduced diameter relative to the projectile body generally. The internal cavity contains a discrete propellant charge 35 together with ignition means (not shown) for igniting the propellant charge. The arrangements for igniting the propellant charge may suitably be similar to those described in the earlier International Patent Application PCT/AU94/00124, assigned to the present applicant.

A forward sealing surface 36 is provided on the projectile head, together with a complementary rearward sealing surface 37 at the periphery of the rearward opening 33, which is arranged for operative sealing engagement with the sealing surface 36 of projectile head 32.

Figure 4:
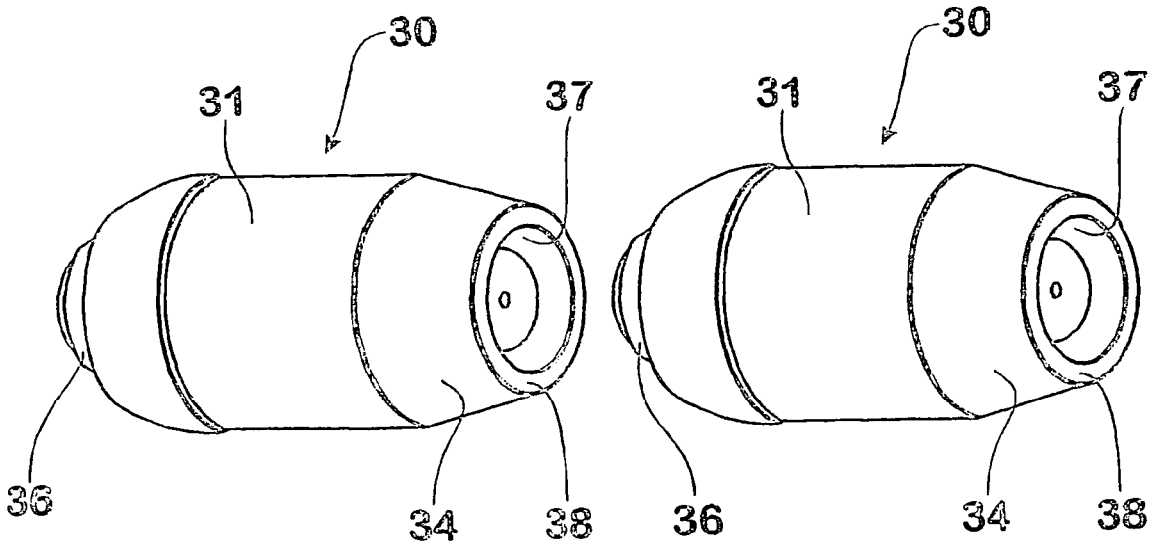
FIG. 4 is a partially fragmented isometric view of two projectile assemblies of the second embodiment.

FIG. 4 illustrates two(2) projectiles 30 of a second embodiment in substantially axial alignment, although they are spaced in the drawing apart for clarity. If required, a front face of the projectile body 31 may include an annular portion (not shown) transverse to a longitudinal axis 39 and arranged to abut the transverse, annular rear end face 38 of a leading projectile. This arrangement might be provided to limit the travel of the head 32 of a trailing projectile into the rearward mouth 33 of a leading projectile, thus minimising the possibility of the respective sealing faces 36, 37 becoming locked together through over-travel and/or deformation caused by repeated application of compressive forces to a chain or stack of projectile assemblies in a barrel.

Figure 5:
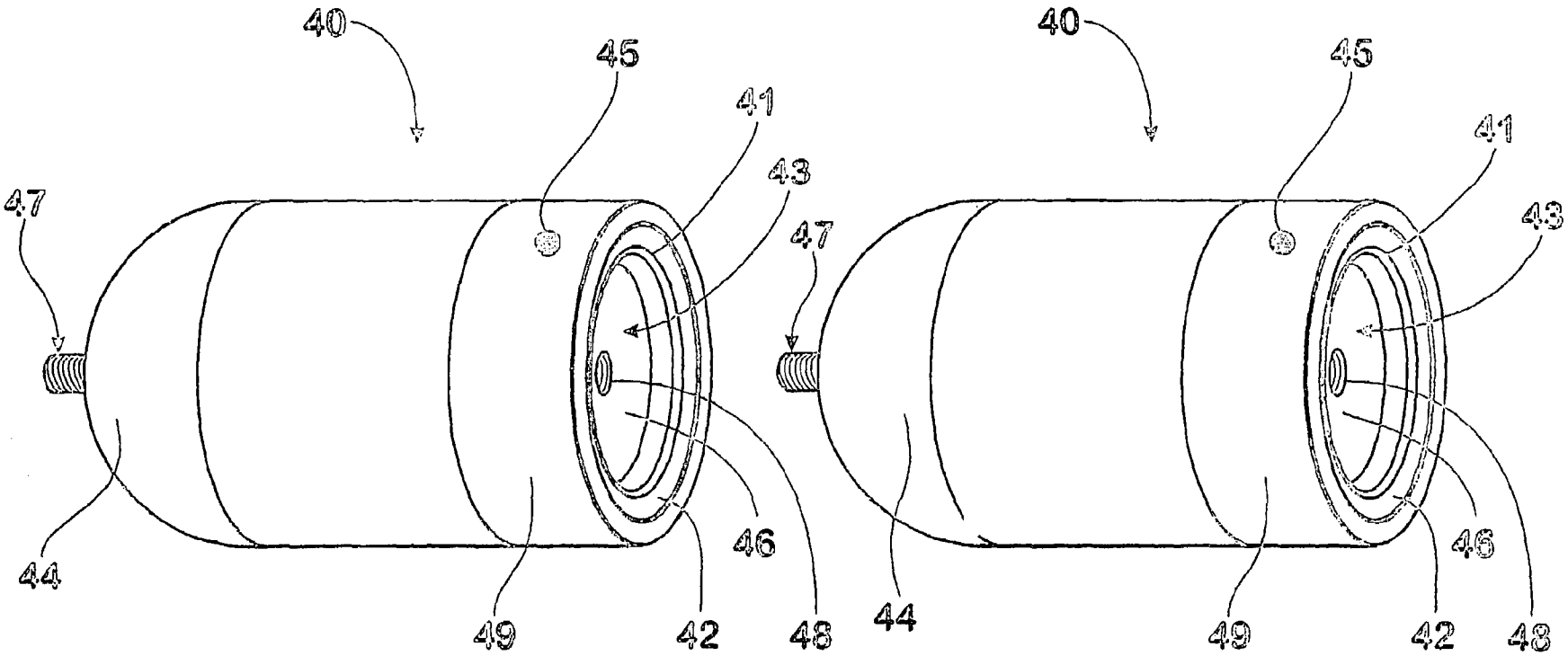
FIG. 5 is an isometric view of projectile assemblies including a sealing arrangement of a third embodiment of the invention.

Turning to FIG. 5, there is shown projectile assemblies 40 of generally similar configuration to that described above in relation to FIGS. 1 and 2. Each projectile assembly 40 includes a sealing means in the form of a gasket 41 retained on the rearward sealing surface 42 of an opening 43 adjacent the projectile tail portion 49. This first gasket 41, which may be composed of stainless steel or a suitably specified synthetic material, provides for enhanced sealing between the rearward sealing surface 42 and the forward sealing surface 44 of the projectile head. A double seal may be achieved, if required, by providing a second gasket (suitably spaced from the first gasket 41) on the projectile head. However, sealing means disposed on the projectile head can detract from the aerodynamic performance of the projectile assembly 40.

In other variations of the third embodiment, the sealing means may comprise an adhesive sealing material that forms a seal between abutting projectile assemblies in situ, and might also function to retain a plurality of projectiles in a chain for ease of loading into a barrel. A propellant charge 45 is retained with the body of the projectile assembly 40, and may be formed as a solid block or as flowable material, such as powder or granules, as in the present embodiment.

This embodiment further includes a closure for the rearward opening 43, in the form of a burstable disc 46, for retaining the flowable propellant charge 45. The closure, which may alternatively be formed of a combustible material rather than a burstable disc, includes retaining means that releasably engage with complementary retaining means on an adjacent projectile head. The retaining means in the present embodiment are formed by a spigot member 47 on the head, and by a socket member 48 provided in the burstable disc 46, which members each include respective cooperating screw-threads allowing subsequent release as desired. In other embodiments using a solid block of propellant, retaining means may include a socket formed directly in the propellant block.

The spigot and socket members 47, 48 of the retaining means may together comprise a frangible coupling. Rather than cooperating threads, the coupling may be released with the assistance of combustion, most desirably that present during firing. A plurality of projectile assemblies 40 can accordingly be coupled together to form a chain of projectiles for ease of handling and subsequent loading into a barrel.

Figure 6:
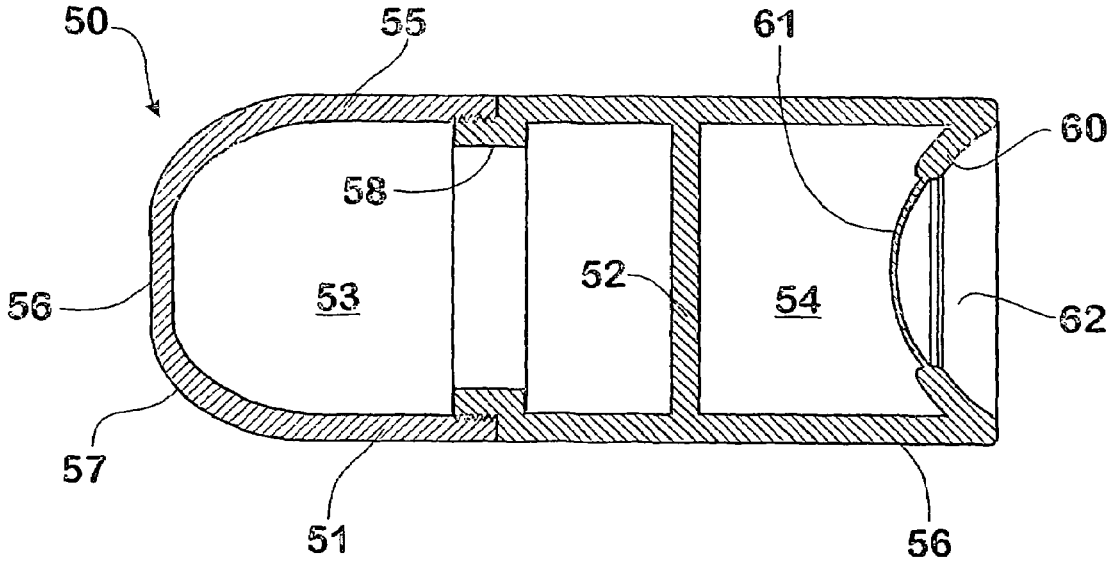
FIG. 6 is a sectional side elevational view of a projectile assembly of a fourth embodiment of the present invention.
Figure 7:
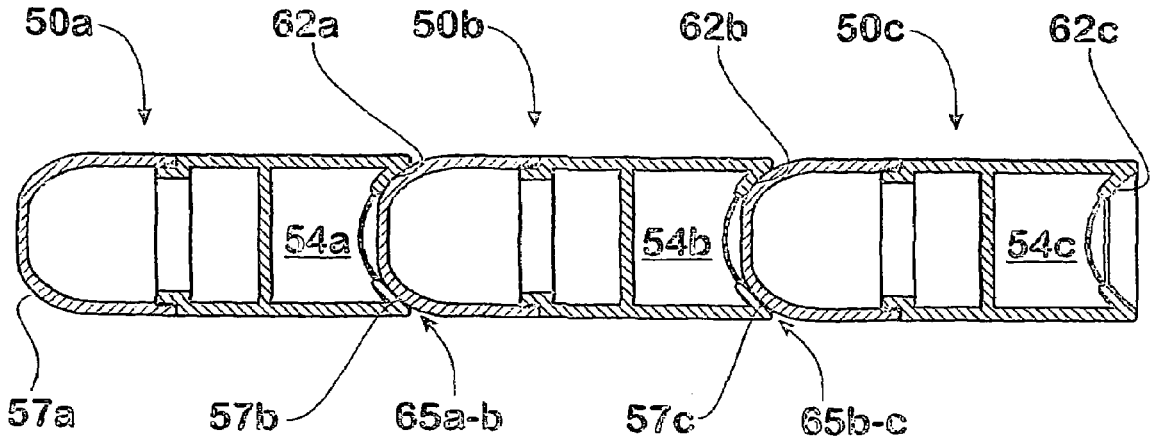
FIG. 7 is a further section side elevational view of a projectile assembly of abutting projectiles of the fourth embodiment.

FIGS. 6 and 7 illustrate, in cross-section, projectiles 50 of a fourth embodiment of the invention. The projectile 50 shown in FIG. 6 includes an outer wall 51 defining an internal cavity and a transverse inner wall 52 dividing the cavity into a cargo or payload cavity 53 and a propellant cavity 54. The projectile body may be notionally divided into a head portion 55 and a tail portion 56 for ease of reference.

The forward external surface of the head portion 55 includes a flattened or truncated forward end 56 and a convex sealing surface 57. An inner surface of the head portion includes an inwardly extending strengthening rib 58 for the cargo or payload cavity 53. It will be appreciated that the rib 58 may, in one form, include a screw-thread arrangement for facilitating access to the payload cavity, as required.

The propellant cavity 54 can communicate externally of the projectile via a rearward mouth or opening 59 at the tail portion 56 of the projectile, which mouth is defined by an inwardly extending annular wall 60. The opening 59 is covered by a closure, here in the form of a burstable disc 61, adapted for rupture upon ignition of the flowable propellant (not shown) contained therein. A rearward sealing surface 62 of the annular wall 60 has a concave shape which is generally complementary to the convex sealing surface 57.

Turning to FIG. 7 which shows a stack of three(3) projectiles 50*a*, 50*b*, 50*c* of the fourth embodiment, arranged in axially abutting relation as disposed in a barrel (not shown). Accordingly, the propellant cavity 54*a* of the first projectile 50*a* is sealed at interface 65*a-b* formed by cooperation of the rearward sealing surface 62*a* of the first projectile with the forward sealing surface 57*b* of the next adjacent (second) projectile 50*b*. In turn, the propellant cavity 54*b* of the second projectile 50*b* is sealed at interface 65*b-c* formed by cooperation of its rearward sealing surface 62*b* with the forward sealing surface 57*c* of the next adjacent (third) projectile 50*c*.

Figure 8:
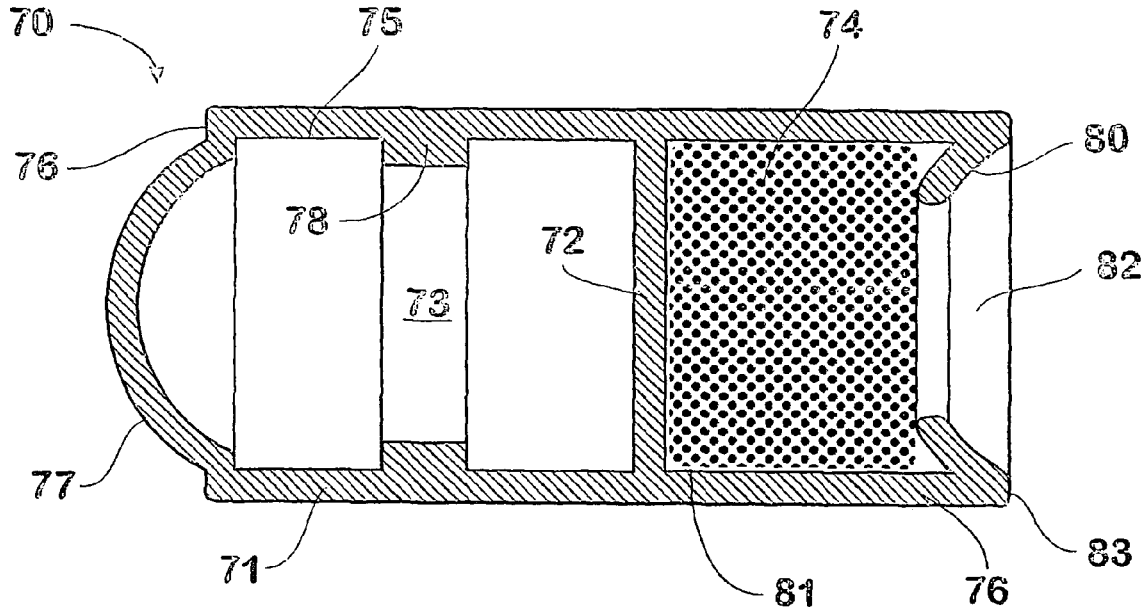
FIG. 8 is a sectional side elevational view of a projectile assembly of a fifth embodiment of the present invention.
Figure 9:
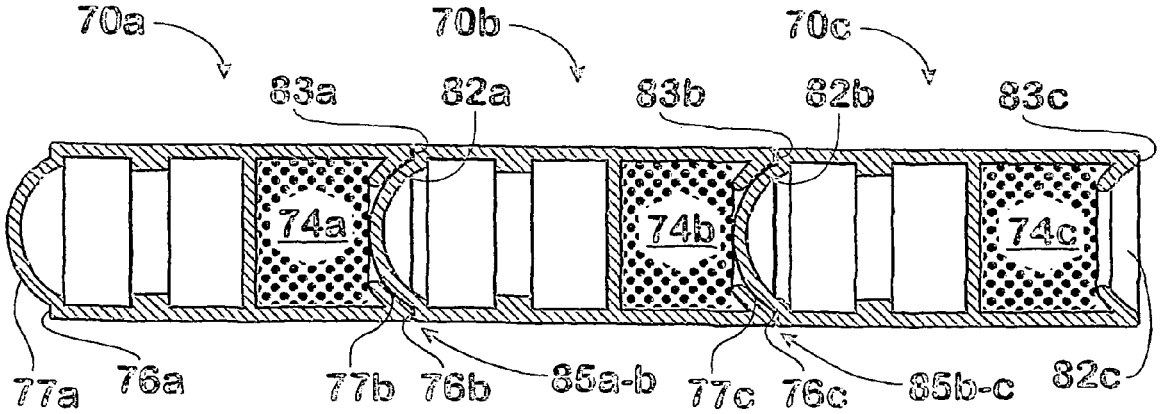
FIG. 9 is a further section side elevational view of a projectile assembly of abutting projectiles of the fifth embodiment.

FIGS. 8 and 9 illustrate, in cross-section, projectiles 70 of a fifth embodiment of the invention. The projectile 70 shown in FIG. 8 includes an outer wall 71 defining an internal cavity and a transverse inner wall 72 dividing the internal cavity into a cargo or payload cavity 73 and a propellant cavity 74. The projectile body may again be notionally divided into a head portion 75 and a tail portion 76 for ease of reference.

The forward outer surface of the head portion 75 includes a transverse annular surface 76, located at the transition from a cylindrical side wall to a partially spherical front wall of the head portion 75, said front wall having a forward convex sealing surface 77. An inner surface of the head portion 75 of projectile 70 includes an inwardly extending strengthening rib 78 for the cargo or payload cavity 73.

The propellant cavity 74 can communicate externally of the projectile via a rearward mouth or opening 79 at the tail portion 76 of the projectile, which mouth is defined by an inwardly extending annular wall 80. A solidified block of propellant 81 (shown in phantom) may be contained in the propellant cavity 74. A rearward sealing surface 82 of the annular wall 80 has a concave shape which is generally complementary to the convex, spherical, sealing surface 77.

Turning to FIG. 9 which shows a stack of three(3) projectiles 70*a*, 70*b*, 70*c* of the fifth embodiment, arranged in axially abutting relation as stacked in a barrel (not shown). Accordingly, the propellant cavity 74*a* of the first projectile 70*a* is sealed at interface 85*a-b* formed by cooperation of the rearward sealing surface 82*a* of the first projectile 70*a* with the forward sealing surface 77*b* of the next adjacent (second) projectile 70*b*. It will also be seen that the abutment between a rearward corner 83*a* and the lateral annular face 76*b* of respective first and second projectiles resists over-travel and possible deformation of the projectiles 70*a*, 70*b* during axial compression of the projectile stack.

In turn, the propellant cavity 74*b* of the second projectile 70*b* is sealed at interface 85*b-c* formed by cooperation of its rearward sealing surface 82*b* with the forward sealing surface 77*c* of the next adjacent (third) projectile 70*c*. Similarly, over-travel is resisted by abutment of the rearward corner 83*b* of the second projectile 70*b* by the forward lateral face 76*c* of the third projectile 70*c*.

The present invention finds application in weapons for both military and law enforcement uses, although this invention is also applicable for other civilian uses. It has particular application to weapon systems in that it greatly reduces the stress requirements of the barrel and projectile, which also simplifies the manufacturing process. In particular, projectiles including the sealing arrangement of the invention may be utilised with barrels that employ standard construction techniques, including conventional rifling arrangements, as well as with more specialised barrels and weapons.

It is to be understood that the above embodiments have been provided only by way of illustration of this invention and that further modifications and improvements thereto, as would be apparent to persons skilled in the relevant art, are deemed to fall within the broad scope and ambit of the present invention described herein and defined in the claims that follow.

The invention claimed is:

1. A projectile arrangement including at least two projectiles coupled together by a frangible coupling to form a chain, wherein each projectile has a head portion, a tail portion and a respective propellant charge, and wherein the frangible coupling includes a first retaining means disposed on the tail portion of the leading projectile engaged by a screw action with a second retaining means disposed on the head portion of the trailing projectile, wherein the first and second retaining means are threadably engaged.

2. An arrangement according to claim 1 wherein the tail portion of the leading projectile and the head portion of the trailing projectile form a seal around the propellant charge of the leading projectile.

3. An arrangement according to claim 2 wherein the seal includes an adhesive connection between the leading and trailing projectiles.

4. An arrangement according to claim 2 wherein the seal includes contact between complementary surfaces on the leading and trailing projectiles.

5. An arrangement as in claim 1 wherein the first and second retaining means include complementary spigot and socket.

6. An arrangement as in claim 5 wherein the spigot and socket are provided on the trailing and leading projectiles respectively.

7. An arrangement as in claim 1 wherein either the first or second retaining means is frangible.

8. An arrangement as in claim 1 wherein the coupling is broken by combustion of the propellant charge in the leading projectile.

9. An arrangement as in claim 1 wherein the first retaining means includes a socket formed in the propellant charge.

10. A projectile for a chain of projectiles, having a head portion, a tail portion and a respective propellant charge, the tail portion having a first retaining means and the head portion having a second retaining means, wherein each of the first and second retaining means is able to engage corresponding retaining means on a trailing or leading projectile in a chain by a screw action to form respective frangible couplings, wherein the first and second retaining means are threaded.

11. A projectile according to claim 10 wherein the first and second retaining means includes a socket and a spigot.

12. A projectile according to claim 11 wherein either the spigot or the socket is frangible.

13. A projectile as in claim 10 wherein each coupling is frangible by virtue of combustion of the propellant charge in the leading projectile.

14. A projectile as in claim 10 wherein the first retaining means includes a socket formed in the propellant charge.

15. A projectile as in claim 10 wherein the tail portion includes a sealing surface which forms a seal with the trialing projectile.

* * * * *